US009702184B2

(12) United States Patent
Gilmer

(10) Patent No.: US 9,702,184 B2
(45) Date of Patent: Jul. 11, 2017

(54) VENETIAN BLINDS WITH SINGLE SPRING LOADED LIFT

(71) Applicant: Timothy K. Gilmer, Gainesville, GA (US)

(72) Inventor: Timothy K. Gilmer, Gainesville, GA (US)

( * ) Notice: Subject to any disclaimer, the term of this patent is extended or adjusted under 35 U.S.C. 154(b) by 0 days.

(21) Appl. No.: 14/929,884

(22) Filed: Nov. 2, 2015

(65) Prior Publication Data

US 2016/0356083 A1 Dec. 8, 2016

Related U.S. Application Data

(63) Continuation-in-part of application No. 14/729,413, filed on Jun. 3, 2015, now abandoned.

(51) Int. Cl.

| | |
|---|---|
| ***E06B 9/322*** | (2006.01) |
| ***E06B 9/382*** | (2006.01) |
| ***E06B 9/304*** | (2006.01) |
| ***E06B 9/325*** | (2006.01) |
| ***E06B 9/327*** | (2006.01) |
| ***E06B 9/388*** | (2006.01) |

(52) U.S. Cl.

CPC ..... *E06B 9/322* (2013.01); *E06B 9/304* (2013.01); *E06B 9/325* (2013.01); *E06B 9/327* (2013.01); *E06B 9/382* (2013.01); *E06B 9/388* (2013.01); *E06B 2009/3222* (2013.01)

(58) Field of Classification Search

CPC ..... E06B 9/322; E06B 9/303; E06B 9/325; E06B 2009/3222; E06B 9/327; E06B 9/386

USPC ..... 160/168.1 R, 172 R

See application file for complete search history.

(56) References Cited

U.S. PATENT DOCUMENTS

| | | | | |
|---|---|---|---|---|
| 2,738,005 | A | 3/1956 | Nisenson | |
| 2,824,608 | A | 2/1958 | Etten | |
| 2,840,156 | A | 6/1958 | Griesser | |
| 3,407,863 | A | 10/1968 | Griesser | |
| 4,236,566 | A | 12/1980 | Hensel | |
| 4,758,042 | A * | 7/1988 | Liu | B60J 1/2091 160/84.04 |
| 4,915,153 | A * | 4/1990 | Toti | A47H 1/04 160/330 |
| 5,067,541 | A * | 11/1991 | Coslett | B60J 1/2091 160/32 |
| 6,024,154 | A | 2/2000 | Wang et al. | |
| 6,644,372 | B2 | 11/2003 | Judkins | |
| 6,675,861 | B2 | 1/2004 | Palmer et al. | |
| 6,684,930 | B2 | 2/2004 | Palmer et al. | |

(Continued)

FOREIGN PATENT DOCUMENTS

DE 202016003204 U1 * 1/2016

*Primary Examiner* — Blair M Johnson

(74) *Attorney, Agent, or Firm* — Thomas|Horstemeyer, LLP

(57) ABSTRACT

Venetian blinds include a pair of slat lift and guide tapes (27, 28) that extend from the upper rail (12), downwardly through openings (22) in the elongated parallel slats (14) and into the lower rail (13) where they are collected in the lower rail on spools (48). The lift and guide tapes are concave in cross section when in their rectilinear shape and progressively change to flat in cross section as they are pulled into the lower rail and wrapped about tape collector spools.

8 Claims, 2 Drawing Sheets

(56) References Cited

U.S. PATENT DOCUMENTS

| | | | | |
|---|---|---|---|---|
| 6,761,202 | B1 * | 7/2004 | Cheng | E06B 9/322 160/170 |
| 9,217,282 | B2 * | 12/2015 | Defenbaugh | E06B 9/68 |
| 2003/0111190 | A1 | 6/2003 | Palmer et al. | |
| 2003/0111191 | A1 | 6/2003 | Ciuca et al. | |
| 2011/0000628 | A1 | 1/2011 | Anderson et al. | |

* cited by examiner

VENETIAN BLINDS WITH SINGLE SPRING LOADED LIFT

This is a continuation-in-part of U.S. patent application Ser. No. 14/729,413, filed Jun. 3, 2015.

FIELD OF THE INVENTION

This invention concerns shades or "blinds" that include a plurality of parallel slats that can be tilted to open and allow light to be transmitted from one side to the other side of the blinds, or tilted to close and block the transmission of light from one side to the other side of the blinds. Typically these blinds are referred to as Venetian blinds and are used at windows and doors to control the passage of light there through.

BACKGROUND OF THE INVENTION

The prior art Venetian blinds include a series of parallel slats that can be tilted to either open or close visual passage of light from one side to the other side of the blinds. Venetian blinds typically include an upper stationary support rail for mounting to the upper frame of a window and a lower movable support rail, with the slats suspended between the support rails, and pull cords that extend upwardly from the reach of the person operating the blinds to the upper rail then downwardly from the upper rail through openings in the parallel slats to the lower rail. When the person pulls the cords, the bottom rail is pulled upwardly and progressively collects the slats to lift them higher to raise the blinds.

While Venetian blinds have been known and used for many decades, most of them have included the lifting cords described above, which is a concern in the industry because there have been several deaths or near deaths of children that have inadvertently become entangled in the lift cords and have been choked. Further, when the lift cords are pulled downwardly, a significant downward force is applied by the pull cords to the supporting upper rail and its components, which tends to pull the upper rail away from the supportive wall structure. This requires that the upper rail be very securely constructed and securely attached to the window frame and allows the person operating the Venetian blinds to apply significant downward force on the lift cords to lift the lower slats toward the top of the window frame.

When the pull cord has been pulled to lift the lower rail and its adjacent slats to the desired elevation, the operator must manipulate the pull cord while the pull cord holds the slats at the desired position to engage a catch in the upper rail. This prevents the pull cord from allowing the slats and lower rail to move uncontrollably down. But the higher the blinds are raised the more the pull cord is moved downwardly within the reach of children, increasing the hazard of access and injury to children.

Even with the blinds in their fully lowered position with the pull cords out of reach of children, the portion of the pull cords that extend through the slats can still be reached by children. This is known as an accessible inner cord.

Other means have been developed that have attempted to solve the above described problems, but there still remains a need to have affordable cordless Venetian blinds to avoid the hazards, inconvenience and non-durability of the structure that comprises the blinds, and the need to provide cordless blinds and to omit the downward force that is required to raise the blinds.

SUMMARY OF THE INVENTION

This invention to provides improved Venetian blinds that can be manually lifted for raising the blinds and manually moved downwardly to lower the blinds without the use of a pull cord, and with the effort for lifting and lowering the blinds being less than the weight of the blinds as they are accumulated or released.

Another version of this invention is Venetian blinds that include lift and guide tapes that become stiff when formed into a rectilinear configuration and that act as a track to align the slats, and that lose their stiffness when bent and become flat in cross section when moved into a coil as the slats are lifted.

The invention provides a reliable and easily applied "brake" in Venetian blinds that positively maintains the lower rail at a desired height.

The cordless Venetian blinds can allow the bottom rail to be manually leveled by lifting or lowering an end of the bottom rail.

Other objects, features and advantages of the present invention will become apparent upon reading the following specification, when taken in conjunction with the accompanying drawings.

DETAILED DESCRIPTION

Figure 1:
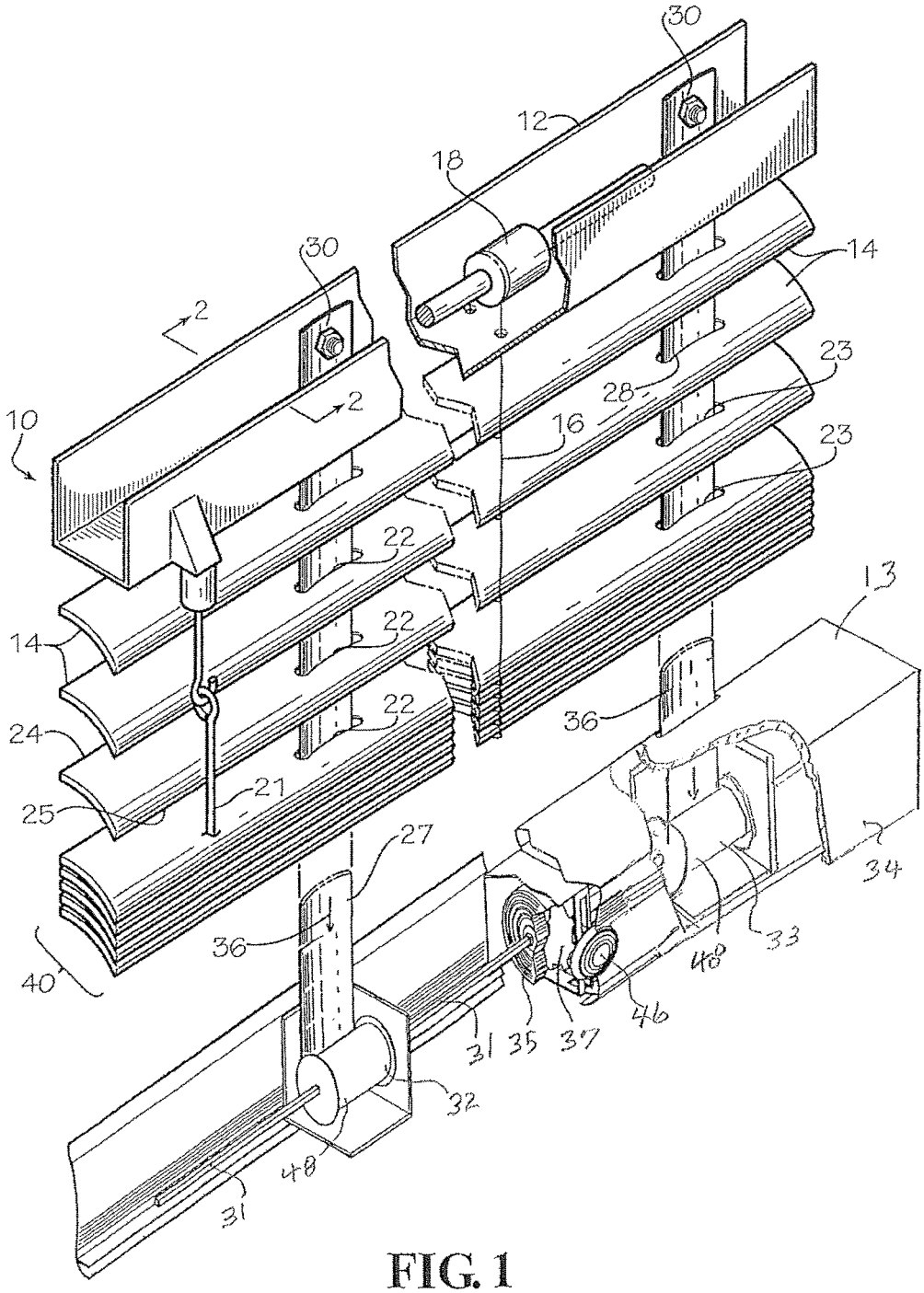
FIG. 1 is a perspective view of a portion of a set of Venetian blinds, with some portions of the blinds removed for the purpose of showing the various components of the blinds, and without the conventional ladder strings that support the slats in their spaced relationship.

Referring now in more detail to the drawings, in which like numerals indicate like parts throughout the several views, FIG. 1 shows assembled Venetian blinds with some parts that are removed for clarity. The Venetian blinds 10 include an upper stationary support rail 12, a lower movable support rail 13, and a plurality of elongated and spaced slats 14 extending parallel to one another and positioned between the lower rail 13 and upper rail 12. A pair of conventional ladder strings 16 extend downwardly from the upper rail 12.

Figure 2:
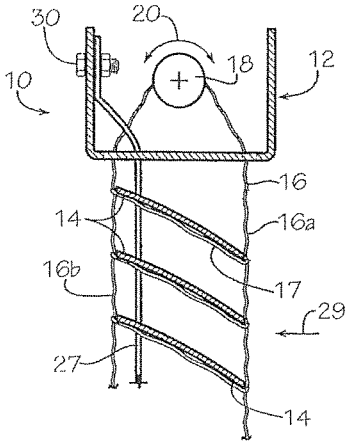
FIG. 2 is a side view of the upper portion of the Venetian blinds shown along lines 2-2 of FIG. 1, including the upper rail and the ladder strings.
Figure 3:
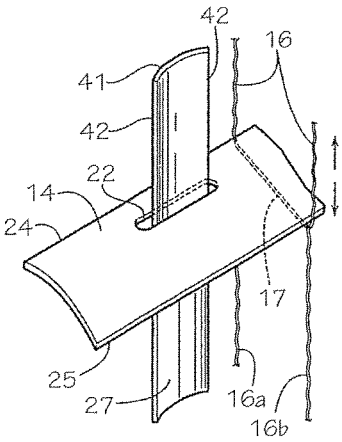
FIG. 3 is a perspective view of the end portion of a single slat and one of its two ladder strings that supports the slats at equally spaced vertical distances from one another, and one of the two lift and guide tapes extending through the aligned openings of the slats.
Figure 7:
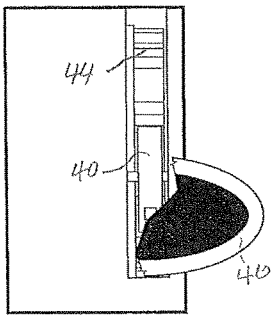
FIG. 7 is a front view of a portion of the lower rail, showing a portion of the actuator button that controls the position of the pawl.

As best shown in FIGS. 2 and 3, the ladder strings 16 each include a pair of vertical support lines **16*a* and 16*b* that are positioned on opposite sides of the slats 14 and a series of laterally extending parallel slat support legs 17** that extend between the pair of vertical support legs. The ladder strings support the slats in the conventional manner.

As shown in FIG. 2 the vertical support lines 16*a* and 16*b* of the ladder strings 16 extend upwardly into the upper stationary support rail about a rotatable drum 18 and the drum can be rotated as indicated by arrows 20 in FIG. 2. The ladder strings 16 extend over the rotatable drum and the drum may be rotated in the conventional manner by a person rotating the control rod 21 as shown in FIG. 1.

When a person rotates the control rod 21, the drum 18 also rotates and the ladder strings 16*a* and 16*b* move up on one side and down on the other side. The support legs 17 of the ladder strings that extend under each slat maintain the elongated parallel slats 14 oriented parallel to each other, thereby reorienting the angles of the elongated parallel slats 14. This is conventional in the art.

As best shown in FIGS. 1 and 3, each of the slats 14 defines a pair of lift and guide tape openings 22 and 23 that are oblong in shape, with a long axis parallel to the length of the elongated parallel slats. Preferably, the lift and guide tape openings 22 and 23 are positioned closer to the outer edge 24 of the slats 14 adjacent the window (not shown) than the inner edge 25. The outer edge 24 of slats faces the window opening and the inner edge 25 faces away from the window opening (not shown). When the elongated parallel slats are tilted, the inner edge 25 of the slats tends to block the view of the lift and guide tape opening 22, as shown by arrow 29 in FIG. 2.

Lift and guide tapes 27 and 28 extend from the lower movable support rail 13 up through the support tape openings 22 and 23 in the slats 14, up to the upper rail 12 and into the upper rail and are attached to the upper rail by screws or other conventional connector means 30.

The tape collectors 32 and 33 are mounted in the lower rail 13 as shown in FIG. 1 and the lift and guide tapes are wound around the spools 48 of the tape collectors, and the free ends of the lift and guide tapes 27 and 28 extend upwardly from the tape collectors to the upper rail 12.

As shown in FIG. 1, a rectilinear control rod 31 extends along the length of housing 34 of the lower rail 13. The tape collectors 32 and 33 may be identical, and each tape collector includes a spool 48 fixedly mounted to rectilinear control rod 31 and upon rotation of the tape collectors they receive or pay out the lift and guide tapes.

Figure 6:
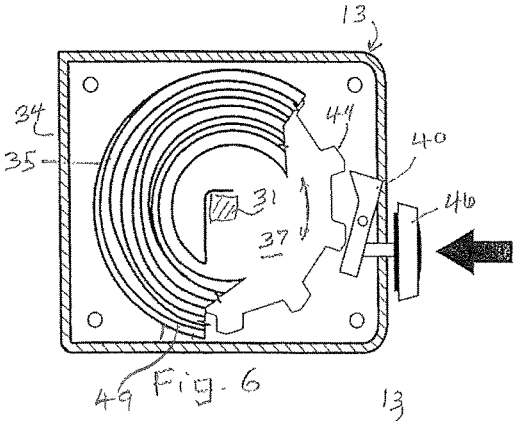
FIG. 6 is an end cross sectional view of the lower lift rail, similar to FIG. 5, but showing the pawl retracted from the teeth of the sprocket.
Figure 4:
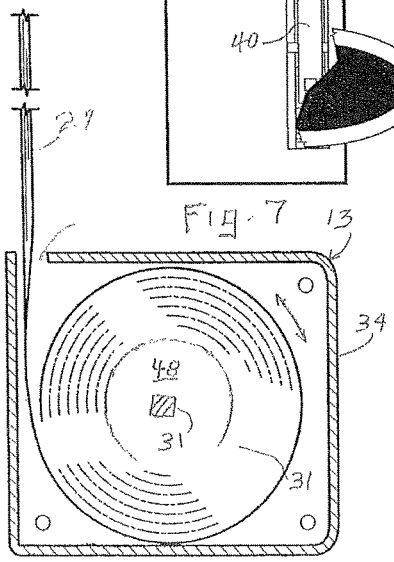
FIG. 4 is a side cross sectional end view of the lower lift rail and one of the tape collectors that is mounted to the lower lift rail, and a portion of one of the two concave lift and guide tapes.
Figure 5:
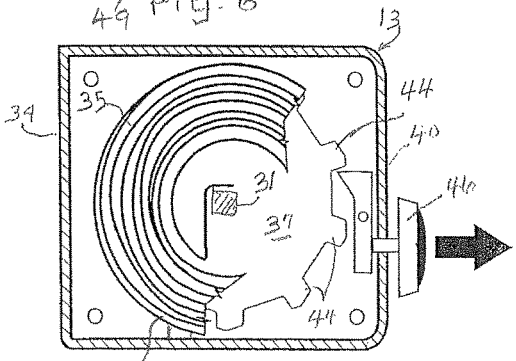
FIG. 5 is an end cross sectional view of the lower lift rail, a partial view of the coil spring and of the sprocket, and showing the pawl engaging the teeth of the sprocket.

As shown in FIGS. 5 and 6, a sprocket 37 is mounted to and is rotatable in unison with the control rod 31. The sprocket includes peripheral teeth 38 that extend radially outwardly from the control rod. A pawl 40 is movably supported by the housing 34 and a spring (not shown) tilts the pawl into engagement with the teeth of the sprocket, as shown in FIG. 5. A button 46 extends between the pawl and to the outside of the lower housing 34 so that when the button is pushed the pawl tilts and withdraws from the sprocket and the sprocket, control rod 31 and spools 48 may rotate in unison. When the button is released the pawl engages the sprocket and stops the rotation of the sprocket 37, control rod 31 and spools 48.

OPERATION

The Venetian blinds 10 will be mounted at a window (not shown) with the upper stationary support rail 12 supported by a bracket or other suitable supportive structure at the desired height, installed in static relationship with respect to the supportive structure. As shown in FIG. 1, the elongated parallel slats 14 are suspended by the pair of ladder strings 16 beneath the upper stationary support rail, with the slats being uniformly spaced apart in parallel orientation. This is conventional.

Usually, when the assembly is being mounted to the window, the lower rail 13 will be positioned adjacent the upper rail 12 with the lift and guide tapes 27 fully wound about the spools 48 and the pawl 40 engaging the teeth of the sprocket 37. The coil spring 35 will be wound tighter as the lower rail is moved to its lowermost position. When the lower rail reaches its lowermost position, the tighter condition of the coil spring applies its maximum torque force to the lift and guide tapes 27, and the portions of the lift and guide tapes wrapped about the spools 48 will be in a flat configuration.

The pawl's re-engagement with the teeth of the sprocket 37 freezes the vertical movement of the lower rail.

The lift and guide support tapes are conventional in the prior art, and usually are a heat treated powder coated steel with smooth surfaces to allow some slippage of the tape in the coil. There is a small amount of slippage between the layers of the tapes in their wound configuration in reels on the spools that may be overcome when leveling the lower rail 13. If the lower rail 13 is not level, a person can tilt the lower rail by lifting an end of the lower rail until the lower rail becomes and remains horizontal.

When the lift and guide support tapes are rectilinear they are concave in cross section. The concave cross section of the straight spans of the lift and guide tapes tend to engage the opposed edges of the tape openings. The bending of the tapes as the tapes are wound about the spools 48 causes the tapes to become flat in cross section and easy to wind up in a reel about the spools.

Although preferred embodiments of the invention have been disclosed in detail herein, it will be obvious to those skilled in the art that variations and modifications of the disclosed embodiments can be made without departing from the spirit and scope of the invention as set forth in the following claims.

The invention claimed is:

1. A Venetian blinds assembly for hanging at a window opening, comprising:

an upper rail for mounting above a window opening, a lower rail positioned below the upper rail, a plurality of elongated parallel slats positioned between the upper rail and the lower rail and extending parallel to the upper rail, the parallel slats each including an outer edge for facing the window opening and an inner edge for facing away from the window opening, a pair of tape openings extending through each of the slats adjacent the outer edge of each slat so that when the parallel slats are tilted, the inner edges of the slats block the view of the tape openings, a pair of concave slat lift and guide tapes each including a distal end portion and a proximal end portion, the distal end portion of the concave slat lift and guide tapes being supported by the upper rail, and the proximal end portion of the concave slat lift and guide tapes being suspended downwardly from the upper rail to the lower rail, the concave shape of the lift and guide tapes dimensioned to engage the slats at the tape openings, a control rod extending along the lower rail, tape collectors mounted on the control rod in alignment with the concave slat lift and guide tapes, the slat lift and guide tapes are wound in flat spiral layers about the tape collectors, and the tape collectors are rotatable in unison with the control rod, and the flat spiral layers of the slat lift and guide tapes being slidable with respect to one another to change the length of the lift and guide tapes extending from the lower rail to the upper rail.

2. The Venetian blinds assembly of claim 1, and further including a coil spring surrounding the control rod for biasing the control rod and the pair of tape collectors to reel in the lower portions of the concave slat lift and guide tapes into the lower rail.

3. The Venetian blinds of claim 2, wherein the pair of tape openings in the slats are oblong with a long axis parallel to the length of the elongated parallel slats, and the concave lift and guide tapes have a width extending parallel to the long axis of the tape openings.

4. A Venetian blinds assembly for hanging at a window opening, comprising:

an upper rail for mounting above a window opening, a lower rail positioned below the upper rail, a plurality of elongated parallel slats positioned between the upper rail and the lower rail and extending parallel to the upper rail, the parallel slats each including a pair of tape openings extending there through, with the pairs of tape openings of adjacent slats positioned in alignment with one another, a pair of concave slat lift and guide tapes each including a distal end portion and a proximal end portion, the distal end portion of the concave slat lift and guide tapes being supported by the upper rail, and the proximal end portion of the concave slat lift and guide tapes being suspended downwardly from the upper rail and through the tape openings to the lower rail, a pair of tape collectors mounted in the lower rail, each tape collector of the pair of tape collectors positioned in vertical alignment with the tape openings and in vertical alignment with the slat lift and guide tapes, each tape collector including a spool configured for collecting and flattening the proximal end of a lift and guide tape and forming the lower portion of the lift and guide tape in a coil of the tape or for releasing the proximal end of one of the slat lift and guide tapes in response to raising and lowering the lower rail, respectively, a control rod connected to the spools of the pair of tape collectors for rotating the spools of the tape collectors in unison, a sprocket mounted to, surrounding and rotatable in unison with the control rod, a pawl supported in the lower rail and movable into engagement with the sprocket to terminate the rotation of the control rod and the tape collectors, and the lift and guide tapes being formed of a material that allows sliding of the length of the tape coiled about the spools in the tape collectors without rotating the spools to change the lengths of the lift and guide tapes extending from the lower rail to adjust the level of the lower rail.

5. The Venetian blinds of claim 4, and further including a coil spring surrounding the control rod biased to retract the lift and guide tapes toward the lower rail in response to manually lifting the lower rail toward the upper rail.

6. Venetian blinds for hanging at a window opening, comprising:

an upper rail, a lower rail positioned below the upper rail, a plurality of parallel slats extending horizontally between the upper rail and the lower rail, and a pair of tape openings in each slat, tape collector spools supported in the lower rail, a pair of lift and guide tapes extending vertically from the upper rail, through the tape openings of the parallel slats and wound in layers about the tape collector spools in the lower rail, the portions of the lift and guide tapes extending from the upper rail to the lower rail being concave in cross section, and the layers of the lift and guide tapes wrapped about the collector spools are flat in cross section and are slidable with respect to each other to change the length of the lift and guide tapes extending from the lower rail to the upper rail.

7. The Venetian blinds of claim 6, and further including tension spring in the lower rail that are biased to urge the lift and guide tapes into the lower rail.

8. The Venetian blinds of claim 6, wherein the concave portion of the lift and guide tapes are shaped to engage one side of the tape openings and the edges of the concave lift and guide tapes are shaped to engage the other side of the tape openings.

* * * * *